US009074752B2

(12) United States Patent
Hendriks

(10) Patent No.: US 9,074,752 B2
(45) Date of Patent: Jul. 7, 2015

(54) ELECTRIC REFLECTOR LAMP AND REFLECTOR

(75) Inventor: Bart Hendriks, Turnhout (BE)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 329 days.

(21) Appl. No.: 13/510,381

(22) PCT Filed: Nov. 19, 2010

(86) PCT No.: PCT/IB2010/055307

§ 371 (c)(1), (2), (4) Date: Aug. 6, 2012

(87) PCT Pub. No.: WO2011/064703

PCT Pub. Date: Jun. 3, 2011

(65) Prior Publication Data

US 2013/0141919 A1 Jun. 6, 2013

(30) Foreign Application Priority Data

Nov. 27, 2009 (EP) ..... 09177320

(51) Int. Cl.

| | |
|---|---|
| ***F21V 7/00*** | (2006.01) |
| ***F21V 7/06*** | (2006.01) |
| ***F21V 7/20*** | (2006.01) |
| ***F21V 19/00*** | (2006.01) |
| ***F21V 29/505*** | (2015.01) |

(52) U.S. Cl.

CPC . *F21V 7/20* (2013.01); *F21V 19/00* (2013.01); *F21V 29/505* (2015.01)

(58) Field of Classification Search

CPC ..... F21V 19/00; F21V 7/00
USPC ..... 313/113; 362/296.01, 296.05
See application file for complete search history.

(56) References Cited

U.S. PATENT DOCUMENTS

| | | | | |
|---|---|---|---|---|
| 6,402,348 | B1 * | 6/2002 | Ouellette et al. | 362/296.01 |
| 6,710,522 | B2 * | 3/2004 | Fransen | 313/113 |
| 2007/0081248 | A1 | 4/2007 | Wu | |
| 2009/0066209 | A1 * | 3/2009 | Imamura et al. | 313/113 |
| 2009/0225560 | A1 | 9/2009 | Mukai | |
| 2009/0268456 | A1 | 10/2009 | Mehrtens | |

FOREIGN PATENT DOCUMENTS

| | | | |
|---|---|---|---|
| EP | 1598594 | B1 | 2/2007 |
| EP | 2017668 | A1 | 1/2009 |

(Continued)

*Primary Examiner* — Karabi Guharay

(57) ABSTRACT

A reflector lamp (1) comprising a reflector (2) having an opening (7) opposite to a light emission window (8), an electric lamp (10) comprising a closed lamp vessel (11) positioned with an end portion (16) in the lamp opening of the reflector, an electric element (13) arranged on the optical axis (5) in the lamp vessel, and a support body (20). The support body comprises reflector fastening means (22) for fastening the support body to the reflector, and lamp fastening means (21) for fastening the support body to the end portion of the lamp vessel. Viewed in a direction from the lamp opening along the optical axis towards the light emission window, the support body is fastened to the reflector solely at a mounting location beyond the lamp opening of the reflector. In between the lamp opening and said location beyond the lamp opening of the reflector, the reflector has a largest wall thickness T2, with T2<=T1. A wire cloth 30 is provided in between the reflector body and the legs of the support body as a protection means. The wire cloth extends from the mounting location up to the lamp fastening means.

13 Claims, 2 Drawing Sheets

(56) References Cited

FOREIGN PATENT DOCUMENTS

| | | | |
|---|---|---|---|
| GB | 772550 | | 4/1957 |
| JP | 10312771 | A | 11/1998 |
| JP | 2004318027 | A | 11/2004 |
| JP | 2009048956 | A | 3/2009 |
| JP | 2009259474 | A | 11/2009 |
| WO | 2008072131 | A2 | 6/2008 |
| WO | 2008135084 | A1 | 11/2008 |

* cited by examiner

ELECTRIC REFLECTOR LAMP AND REFLECTOR

FIELD OF THE INVENTION

The invention relates to an electric reflector lamp according to the preamble of claim 1 and a reflector.

BACKGROUND OF THE INVENTION

Such a reflector lamp is known from WO2008/072131, in which the support body provides accurate positioning of the lamp vessel in the reflector. In the known reflector lamp there is no direct mechanical connection between the lamp vessel and the reflector in the critical area at or adjacent the lamp opening of the reflector, thus causing the reflector lamp to be subjected to lower (thermal) stresses. As the area at and/or adjacent the lamp opening is covered by the support body to only a relatively small extent, free or forced convection at the lamp opening, for example an air flow, is made possible. Thus, the use of high-power lamps is enabled. Lamps of higher power are, for example, short-arc high-pressure discharge lamps having a nominal power of, for example, 250 to 500 W during stable operation, as well as, for example, a UHP lamp designed for a power of 450 W during continuous steady-state operation. It is a disadvantage of the known reflector lamp that relatively high temporary stresses still occur in the reflector, especially during ignition and cooldown of the lamp and in particular when relatively cheap hard glass is used as the material for the reflector. Another disadvantage of the known reflector lamp is that cooling of the lamp is yet relatively inefficient.

SUMMARY OF THE INVENTION

It is an object of the invention to provide a reflector lamp of the type described in the opening paragraph in which at least one of the above-mentioned disadvantages is counteracted. To achieve this, the lamp as described in the opening paragraph is characterized by the characterizing part of claim 1. In order to reliably hold the lamp vessel in position in the reflector body, and to counteract unintended fracture of the reflector body, for example due to fracture of the lamp vessel or due to mechanical shocks during handling, the reflector body must have sufficient mechanical strength and robustness. This resulted in the known lamps having a reflector body with an overall relatively large wall thickness. However, in the known lamps said relatively large wall thickness hampers efficient cooling of the lamp as the heat generated in the lamp vessel for a large part must be transported away through the wall of the reflector to the exterior. To enhance the heat transport, a forced air flow along the reflector surface is provided in the reflector lamp. It is known that the above-mentioned high temporary, (thermal) stresses in particular occur in parts of the reflector that are relatively close to the electric element of the lamp vessel as a result of the relatively large wall thickness and the high temperature gradient over the wall of the reflector, in particular adjacent the opening/neck of the reflector. These stresses are proportional to the coefficient of thermal expansion of the applied glass type and can lead to glass cracks especially when applying hard glass for high power lamps. In the reflector lamp of the invention, the mechanical strength and robustness of the lamp is no longer solely obtained by the reflector, but is realized by a combination of the reflector body and the support body, said combination forming a sort of cage in which the lamp vessel is securely held. By virtue thereof the wall thickness of the reflector can be reduced for those parts that are located inside said cage. Experiments revealed that with a wall thickness T2<=T1 for those parts of the reflector body inside the cage, an efficient cooling of the lamp is obtainable, probably as a result of a reduced temperature gradient over the wall of the reflector. Hence, the whole reflector may essentially have a uniform thickness T1 from the light emission window to the lamp opening. At the light emission window said reflectors often have an annular flange or annular indent to provide a pressing/positioning surface or a seat for a transparent plate to close the reflector; in those cases T1 is the wall thickness next to said annular flange/indent. Preferably the wall thickness T2<=0.8*T1 or even less; for example, adjacent the opening, T2 has a value T3<=0.67*T1, to yet further improve the cooling efficiency of the lamp and to reduce the temporary thermal stress to a relatively low level. A minimum wall thickness T2 of the reflector is about 2.4 mm to enable easy manufacturing of the reflector and to ensure that the reflector maintains sufficient strength for a robust reflective surface. In practice said wall thickness generally ranges from about 2 mm to about 5 mm.

In an embodiment the reflector lamp is characterized in that at said mounting location the wall thickness has a stepped profile. As the reflecting surface of the reflector body should remain unaltered, for example its reflective surface should remain shaped like a parabolic or elliptic reflector, i.e. according to a body of revolution of a branch of a parabola or ellipse, the stepped profile provides the reflector body with a ridge on its outer surface at said mounting location. Said ridge simplifies the positioning and mounting of the support structure onto the reflector. A suitable dimension for the ridge is a ridge-width in the range of 0.5 to 1.5 mm, thus reducing the wall thickness by 0.5-1.5 mm, for example from 2.8 mm at the mounting location just outside the cage to, for example, 2 mm or 2.2 mm at the mounting location just inside the cage, hence resulting in a ridge dimension of 0.8 mm or 0.6 mm, respectively.

The first annular wall and the lamp opening are preferably spaced apart by a spacing S in the range of 2 mm to 30 mm in the axial direction in the present reflector lamp. The area at and/or adjacent the lamp opening is thus covered to even a lesser extent by the support body, compared to the conventional known lamps, and free or forced convection, for example an air flow, is even better facilitated.

It is advantageous if the reflector fastening means of the support body comprises a second annular wall. Said second annular wall gives the support body enhanced rigidity and provides a larger contact area between the reflector and the reflector fastening means. Said enhanced rigidity leads to better controlled positioning of the lamp vessel in the reflector, and said larger contact area provides a better fastening of the support body to the reflector.

An embodiment of the reflector lamp is characterized in that the reflector is without a neck portion. This offers the advantage that there is no knee between the cylindrical part of the reflector at the opening and the reflector shell, resulting in a reduction of reflector shape-related stress. Furthermore, the distance between the light- and heat-generating light source and the outside of the reflector is reduced, which leads to better cooling of the lamp vessel. The application of the support body in reflector lamps whose reflector has a neck at the opening will already have a beneficial effect with respect to thermal stress and mechanical stress, compared to the conventional known reflectors, however, a reflector without a neck is preferred for the reason mentioned above.

Another embodiment of the reflector lamp of the invention is characterized in that the support body comprises 2, 3, 4, 5, 6 or 12 or even up to 18 or 24 legs via which it is fastened to the reflector. By virtue thereof, a strong fixation of the lamp vessel onto the reflector and correct positioning of the lamp vessel in the reflector are obtained. The support body is, for example, made of metal, ceramic, high temperature-resistant synthetic resin, or glass. These materials are easily connected to the reflector and the lamp vessel, for example by cementing, gluing, or by clamping in the radial direction. Cementing is a relatively easy method of fastening the support body to the lamp vessel and/or the reflector. Preferably, the coefficient of thermal expansion of the materials of the support body, the lamp vessel, and the reflector match, thus counteracting the occurrence of high mechanical and thermal stresses at their interface(s). A support body made from metal sheeting offers the advantage of being easily pliable and very suitable for fastening both the reflector and the lamp vessel thereto through clamping, because of its resilience. The support body may be provided with resilient tongues for this purpose. A ceramic support body is preferred in cases where a current conductor is led back to the lamp fastening means outside the reflector body, because of its excellent thermal properties and electrically isolating properties, thus counteracting too much exposure of users to electrically conductive materials.

Still another embodiment of the reflector lamp is characterized in that additional protection means are provided that extend at least from the opening to said mounting location. During operation of the lamp, an operating pressure of a few hundred bars, for example 200 bar (1 bar~10^5 Pascal), is present inside the lamp vessel, involving the risk of fracture of the lamp vessel. In the unlikely case of fracture of the lamp vessel, damage/harm to the environment by relatively large fracture parts being scattered into the environment is counteracted by the provision of the additional protection means. In particular parts of the reflector that are located relatively close to the electric element and that have a relatively small wall thickness should preferably be provided with additional protection means. The additional protection means can be, for example, a metal cladding or a pierced metal cladding against the outer surface of the reflector body. Alternatively, a high number of legs, for example 30 or 36 legs, can be considered additional protection means as the spacing between the legs becomes relatively small, hence counteracting that conceivably relatively large fracture parts of the fractured lamp vessel are scattered into the environment. As another alternative a wire cloth can be used as additional protective means. The wire cloth has the advantage that it is flexible and adapts easily to the desired shape, and that the flow of a cooling medium through the protective means and the open construction of the legs is maintained, and hence effective/efficient cooling is maintained. A convenient location to provide the wire cloth is at an inner side of the support body as the legs form easy fixation points. At one end the wire cloth can be cemented together with the support body onto the reflector body and at the other end it can be fixed to the first annular wall of the support body.

Yet another embodiment of the reflector lamp is characterized in that one current conductor extends through the wall of the reflector and through a leg of the electrically isolating support body back to the lamp fastening means. In particular when a (metal) wire cloth is provided as additional protection means, too much exposure of users to electrically conductive materials, by incidental contact between the current conductor and the wire cloth, is then obviated.

Yet another embodiment of the reflector lamp is characterized in that the lamp vessel has two mutually opposed end portions each comprising a respective seal. This renders it possible to position the electric element, for example a discharge arc or a filament, in the focal point and on/along the optical axis in a relatively easy manner.

The invention further relates to a reflector for use in a reflector lamp of the invention. The invention makes new designs for the reflector possible, for example in that the neck of the reflector, conventionally used for fastening the lamp vessel and the reflector to one another, can now be omitted. Furthermore, the wall thickness of the reflector is substantially different from that of known reflectors in that the wall thickness decreases from the light emission window towards the lamp opening, which is the reverse of the wall thickness gradient in the known reflectors. The spider-shaped support body, having 2 to 36 legs, has the advantage that it does not or substantially not increase the built-in dimensions of the reflector lamp in a housing or in an electrical apparatus, for example in that upon projection of the reflector lamp along the axis on a plane transverse to the axis, the projected image of the spider falls within the projected outer contours of the reflector body.

Further advantages, characteristics, and details of the invention will be explained in more detail in the ensuing description of some embodiments. The description is given with reference to the schematic Figures, in which:

DETAILED DESCRIPTION OF THE EMBODIMENTS

Figure 1:
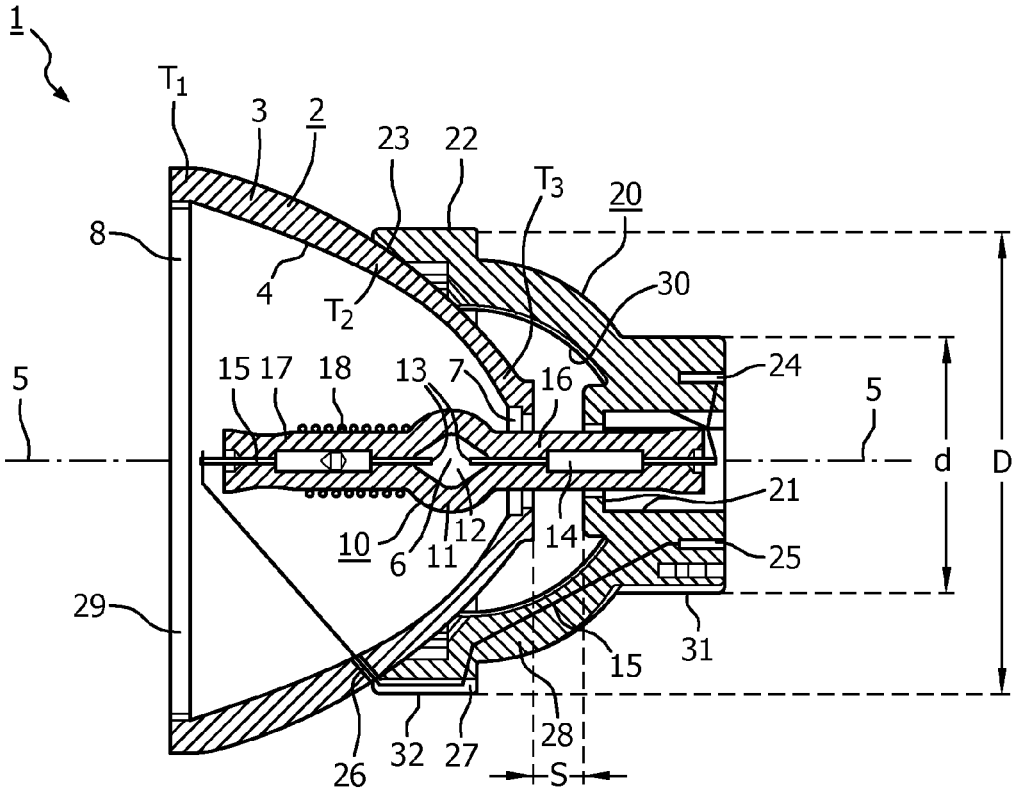
FIG. 1 is a cross-sectional view of a first embodiment of the reflector lamp of the invention.

FIG. 1 shows a cross-sectional view of a reflector lamp 1 comprising a round reflector 2 with a concave reflecting portion 3 with a reflecting surface 4 defining an optical axis 5 and having a focal point 6 on the optical axis, the reflecting surface extending between a lamp opening 7 and a light emission window 8 opposite to the lamp opening of the reflector. The reflector lamp further comprises an electric high-pressure gas discharge lamp 10 comprising a closed lamp vessel 11 positioned with a first end portion 16 in the lamp opening of the reflector. An electric element 13, shown as a pair of mutually opposed electrodes in the Figure, is arranged on the optical axis in a space 12 enclosed by the lamp vessel, and a first current conductor 14 and a second current conductor 15 extend from the electric element through respectively the first end portion 16 and a second end portion 17 to the exterior. The lamp vessel is made from quartz glass, i.e. glass having a $SiO_2$ content of at least 95% by weight. The electric lamp has an antenna 18 serving as an ignition aid, arranged around the second end portion. A support body 20 is provided, said support body comprising reflector fastening means 22 for fastening the support body to the reflector at a mounting location 23, in the Fig. by means of cement, and lamp fastening means 21 for fastening (in the Fig. by means of cement) the support body to the first end portion of the lamp vessel, only partly covering the opening. The support body further has a first electrical contact 24 and a second electrical contact 25 which are electrically connected with the first current conductor 14 and the second current conductor 15, respectively. In a direction away from the lamp opening along the optical axis towards the light emission window, the support body is fastened to the reflector solely at a location relatively remote from the lamp opening of the reflector, even beyond the focal point of the reflector. The second current conductor extends through a hole 26 in the reflector portion to the support body and is guided via a groove 27 in a leg 28 of the support body to the second electrical contact 25. In the embodiment of FIG. 1 the support body has twelve legs 28 evenly distributed over the circumference of the support body (and hence the reflector). As is shown in FIG. 1, the reflector is without a neck portion. The reflector is made of hard glass, borosilicate glass in the lamp shown in FIG. 1, but it may alternatively be made of aluminosilicate glass or glass ceramic. The reflector has a wall thickness which gradually decreases from the light emission window towards the neck opening. In between the lamp opening and the mount location the wall thickness has a largest value T2 which is about 0.75 times the wall thickness T1 at the light emission window. The wall thickness T3 adjacent the opening is about 0.65 times the wall thickness T1 of the reflector at the light emission window. The reflector is provided with a protective, transparent glass plate 29 in the light emission window. The glass plate closes the reflector, thus counteracting that fracture parts of a fractured lamp are scattered into the environment. The glass plate is provided with an anti-reflection coating, for example MgF2. As additional protective means a wire cloth 30 is provided in between the reflector body and the legs of the support body, and extends from the mounting location up to the lamp fastening means.

Figure 2A:
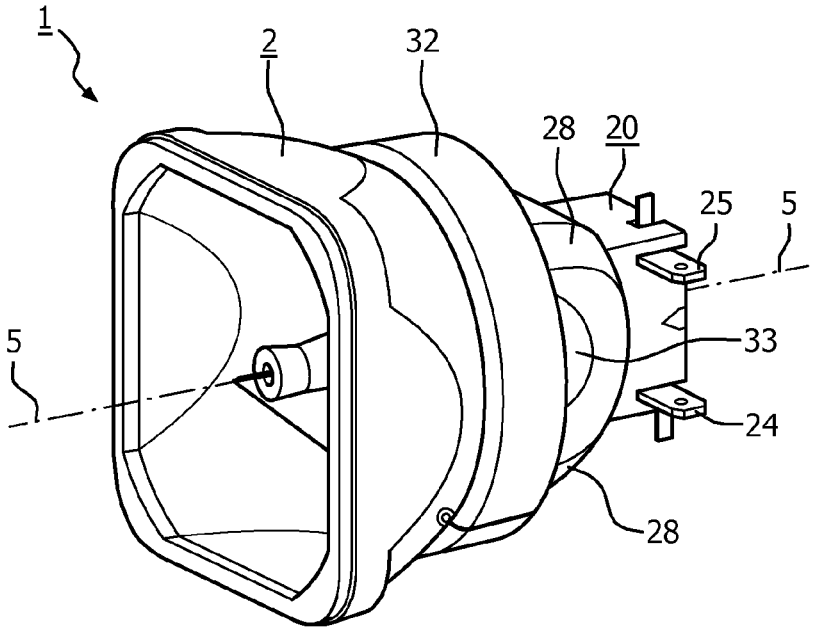
FIG. 2A is a perspective front view of a second embodiment of the reflector lamp of the invention.
Figure 2B:
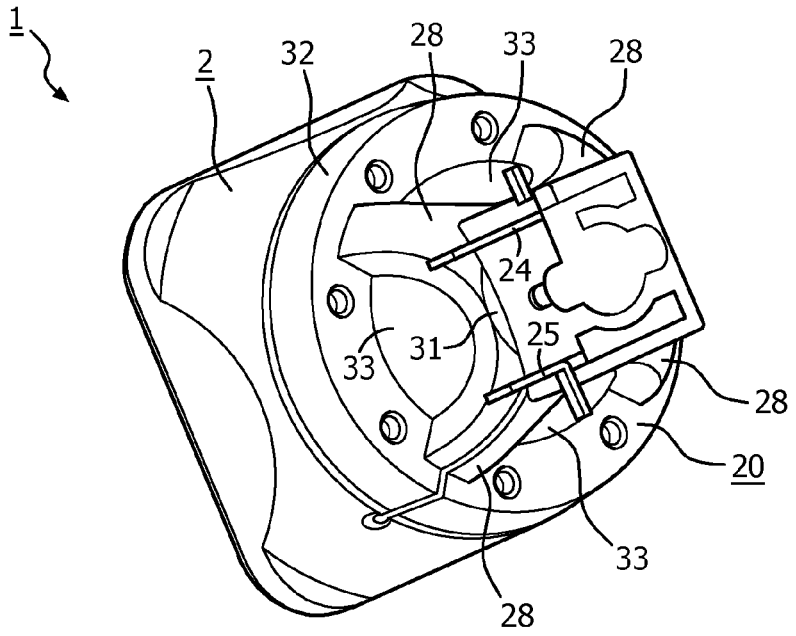
FIG. 2B is a perspective rear view of the reflector lamp of FIG. 2A.

FIGS. 2A and 2B show respectively a front and a rear perspective view of a second embodiment of the reflector lamp 1 comprising a rectangular reflector body 2 and a four-legged support body 20. The support body is made of ceramic material, in this case sintered aluminum oxide, and comprises as the lamp fastening means a first annular wall 31 (see FIG. 1) around the first end portion 16 (see FIG. 1), four legs 28 and a second annular wall 32 as the reflector fastening means. Said legs 28 connect the first annular wall 31 with the second annular wall 32. The second annular wall being concentric with the first annular wall, said first and second annular walls have respective outer diameters d and D, the diameter d of the first annular wall being smaller than the diameter D of the second annular wall (see FIG. 1). The legs extend along the optical axis 5 in a curved way and are evenly distributed over the circumference of the reflector, i.e. at mutual angles of 90° in a plane projection along the optical axis. Between the legs 28 ventilation openings 33 are present which enable efficient cooling via free or forced convection of a cooling fluid. Both the lamp vessel and the reflector are fastened to the support body by cement. The first annular wall and the lamp opening 7 are spaced apart in the axial direction by a spacing S of 8 mm (see FIG. 1). The support body 20 further has two electrical contacts 24 and 25. In the embodiment of FIGS. 2A and 2B the reflector is without a glass plate.

Figure 3:
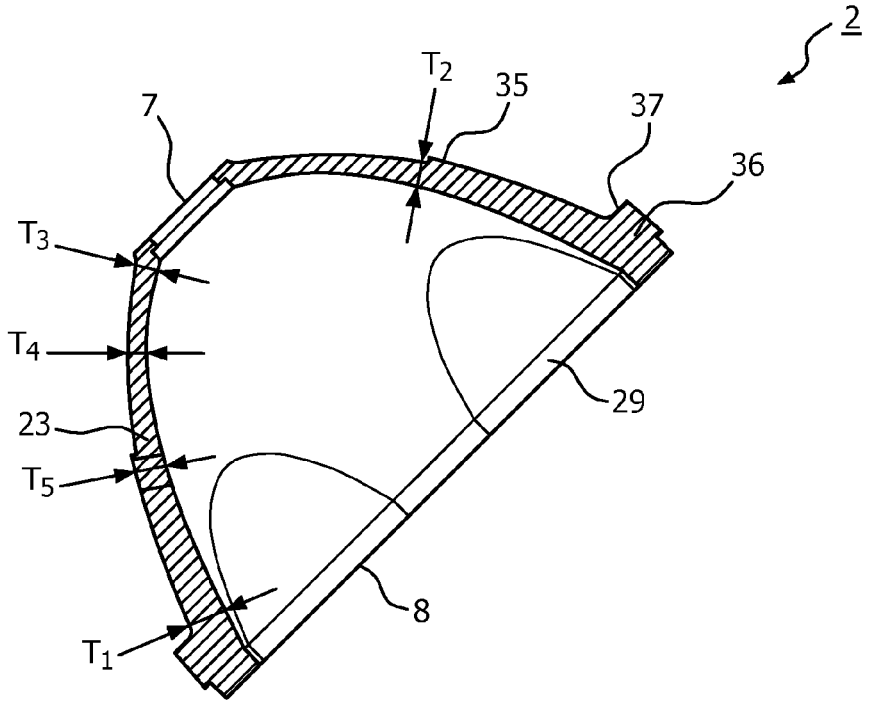
FIG. 3 is a cross-sectional view of a reflector of the reflector lamp of the invention.

FIG. 3 shows a cross-section of a third embodiment of a reflector 2 of the reflector lamp according to the invention. The rectangular reflector has a wall extending from the light emission window 8 towards the lamp opening 7, the wall having a gradually variable wall thickness, however, with a stepped profile 35 at a mounting location 23 for enabling easy mounting of the support body. The stepped profile has a ridge with a dimension of 0.8 mm. The reflector is further provided with a flange 36 which, with a side 37 turned towards the lamp opening, can serve as a pressing surface for keeping the reflector lamp according to the invention positioned inside a projector. The wall thickness T1 of the reflector adjacent the light emission window is to be determined just behind the flange, viewed in a direction away from the light emission window; in the FIG. T1 is 3.8 mm. Adjacent the stepped profile and between the mounting location and the lamp opening, the reflector has a largest thickness T2 of 2.6 mm. i.e. T2~0.68*T1. Adjacent the stepped profile and between the mounting position and the light emission window the reflector has a wall thickness T5 of 3.4 mm. The wall thickness T3 of the reflector adjacent the lamp opening is 2.4 mm, i.e. T3~0.63*T1. Between the lamp opening and the mounting location the reflector has a smallest thickness T4 of 2.1 mm. The reflector is closed with a transparent glass plate 29.

Although only some exemplary embodiments of this invention have been described in detail, those skilled in the art will readily appreciate that many modifications are possible without materially departing from the novel teachings and advantages of the invention. Accordingly, all such modifications, such as the reflector having a transparent plate (optionally coated with an anti-reflection layer) positioned in the light emission window, or the first end portion of the lamp vessel being provided with an ignition antenna, are intended to fall within the scope of this invention.

The invention claimed is:

1. A reflector lamp comprising:

a reflector with a reflecting surface defining an optical axis and having a focal point on the optical axis, the reflecting surface extending between a lamp opening in the reflector and a light emission window opposite to the lamp opening, an electric lamp comprising a closed lamp vessel an end portion of which is positioned in the lamp opening, an electric element arranged on the optical axis in the lamp vessel, and a current conductor extending from the electric element through the end portion to the exterior, a support body comprising lamp fastening means for fastening the support body to the end portion of the lamp vessel and reflector fastening means for fastening the support body to the reflector, the lamp fastening means comprising a first annular wall around the end portion of the lamp vessel, the reflector fastening means comprising a plurality of legs that are attached to the first annular wall of the lamp fastening means, each leg extending in a direction from the lamp opening in the reflector along the optical axis towards the light emission window at an acute angle a to the optical axis, viewed in a direction from the lamp opening along the optical axis towards the light emission window, the support body is fastened to the reflector solely at a mounting location beyond the lamp opening of the reflector, the reflector having a wall thickness distribution with a wall thickness T1 adjacent the light emission window, characterized in that in between the lamp opening and said mounting location the reflector has a largest wall thickness T2, with T2<=T1, and wherein adjacent the opening the wall thickness T3<=0.67*T1.

2. A reflector lamp as claimed in claim 1, characterized in that at said mounting location the wall thickness has a stepped profile.

3. A reflector lamp as claimed in claim 1, characterized in that the plurality of legs is in the range of 2 to 6 legs.

4. A reflector lamp as claimed in claim 1, characterized in that the reflector fastening means of the support body further comprises a second annular wall, said second annular wall being concentric with the first annular wall and being connected thereto via the legs, and said first and second annular wall have respective outer diameters d and D, the diameter d of the first annular wall being smaller than the diameter D of the second annular wall.

5. A reflector lamp as claimed in claim 1, characterized in that the first annular wall and the lamp opening are spaced apart in the axial direction by a spacing S lying in a range of 2 mm to 30 mm.

6. A reflector lamp as claimed in claim 1, characterized in that the reflector is without a neck portion.

7. A reflector lamp as claimed in claim 1, characterized in that the support body is made of metal, ceramic material, or glass.

8. A reflector lamp as claimed in claim 1, characterized in that the support body is cemented to the reflector.

9. A reflector lamp as claimed in claim 1, characterized in that one current conductor extends through the wall of the reflector and through one leg of the support body back to the lamp fastening means.

10. A reflector lamp as claimed in claim 1, characterized in that the lamp vessel has two mutually opposed end portions each comprising a respective seal.

11. A reflector comprising all the reflector characteristics as defined in the reflector lamp as claimed in claim 1.

12. A reflector lamp comprising:

a reflector with a reflecting surface defining an optical axis and having a focal point on the optical axis, the reflecting surface extending between a lamp opening in the reflector and a light emission window opposite to the lamp opening, an electric lamp comprising a closed lamp vessel an end portion of which is positioned in the lamp opening, an electric element arranged on the optical axis in the lamp vessel, and a current conductor extending from the electric element through the end portion to the exterior, a support body comprising lamp fastening means for fastening the support body to the end portion of the lamp vessel and reflector fastening means for fastening the support body to the reflector, the lamp fastening means comprising a first annular wall around the end portion of the lamp vessel, the reflector fastening means comprising a plurality of legs that are attached to the first annular wall of the lamp fastening means, each leg extending in a direction from the lamp opening in the reflector along the optical axis towards the light emission window at an acute angle a to the optical axis, viewed in a direction from the lamp opening along the optical axis towards the light emission window, the support body is fastened to the reflector solely at a mounting location beyond the lamp opening of the reflector, the reflector having a wall thickness distribution with a wall thickness T1 adjacent the light emission window, characterized in that in between the lamp opening and said mounting location the reflector has a largest wall thickness T2, with T2<=T1, wherein additional protection means are provided that extend at least from the first annular wall to said mounting location and said additional protection means is a wire cloth.

13. A reflector lamp as claimed in claim 12, characterized in that said wire cloth is provided at an inner side of the support body.

* * * * *